US012497224B2

(12) United States Patent
Falzoni et al.

(10) Patent No.: US 12,497,224 B2
(45) Date of Patent: Dec. 16, 2025

(54) CAP FOR CONTAINER

(71) Applicant: SACMI COOPERATIVA MECCANICI IMOLA SOCIETA' COOPERATIVA, Imola (IT)

(72) Inventors: Alessandro Falzoni, Imola (IT); Vittorio Bassi, Faenza (IT)

(73) Assignee: SACMI COOPERATIVA MECCANICI IMOLA SOCIETA' COOPERATIVA, Imola (IT)

( * ) Notice: Subject to any disclaimer, the term of this patent is extended or adjusted under 35 U.S.C. 154(b) by 0 days.

(21) Appl. No.: 18/705,181

(22) PCT Filed: Nov. 7, 2022

(86) PCT No.: PCT/IB2022/060678
§ 371 (c)(1),
(2) Date: Apr. 26, 2024

(87) PCT Pub. No.: WO2023/079517
PCT Pub. Date: May 11, 2023

(65) Prior Publication Data

US 2024/0417149 A1 Dec. 19, 2024

(30) Foreign Application Priority Data

Nov. 8, 2021 (IT) ..... 102021000028391

(51) Int. Cl.
*B65D 55/16* (2006.01)
*B65D 41/34* (2006.01)

(52) U.S. Cl.
CPC ..... *B65D 55/16* (2013.01); *B65D 41/3428* (2013.01); *B65D 2401/30* (2020.05)

(58) Field of Classification Search
CPC ..... B65D 55/16; B65D 41/3428; B65D 2401/30; B65D 2251/04; B65D 2251/1008
See application file for complete search history.

(56) References Cited

FOREIGN PATENT DOCUMENTS

DE 202021106471 U1 * 1/2022
EP 3766797 1/2021
(Continued)

OTHER PUBLICATIONS

Translation of DE 202021106471. (Year: 2025).*
(Continued)

*Primary Examiner* — James N Smalley
(74) *Attorney, Agent, or Firm* — Chrisman Gallo Tochtrop LLC

(57) ABSTRACT

A closing cap for a container having a lateral wall and a transversal wall positioned at one end of the lateral wall, a separating line being provided on the lateral wall to define a retaining ring that is configured to internally engage with a stop ring of a neck of the container as to remain anchored to the neck, and a closing element removably engageable with the neck, so as to open or close the container. The separating line is circumferentially interrupted to define in the lateral wall a joining zone in which the retaining ring and the closing element are joined. The cap additionally includes an inner thread structure positioned on the inside of the lateral wall for engaging with an outer thread structure of the neck and removably coupling the closing element to the neck of the container.

13 Claims, 5 Drawing Sheets

(56) References Cited

FOREIGN PATENT DOCUMENTS

| | | |
|---|---|---|
| FR | 3106582 | 7/2021 |
| JP | 5590913 | 9/2011 |
| WO | 2010040961 | 4/2010 |
| WO | 2019177616 | 9/2019 |
| WO | 2020126925 | 6/2020 |
| WO | 2021021095 | 2/2021 |
| WO | WO-2022029110 A1 * | 2/2022 |

OTHER PUBLICATIONS

International Search Report and Written Opinion issued in PCT/IB2022/060678 on Mar. 2, 2023, 10 pages.
Third Party Observations, submitted in PCT/IB2022/060678 on Feb. 28, 2024, 5 pages.

* cited by examiner

Fig.6
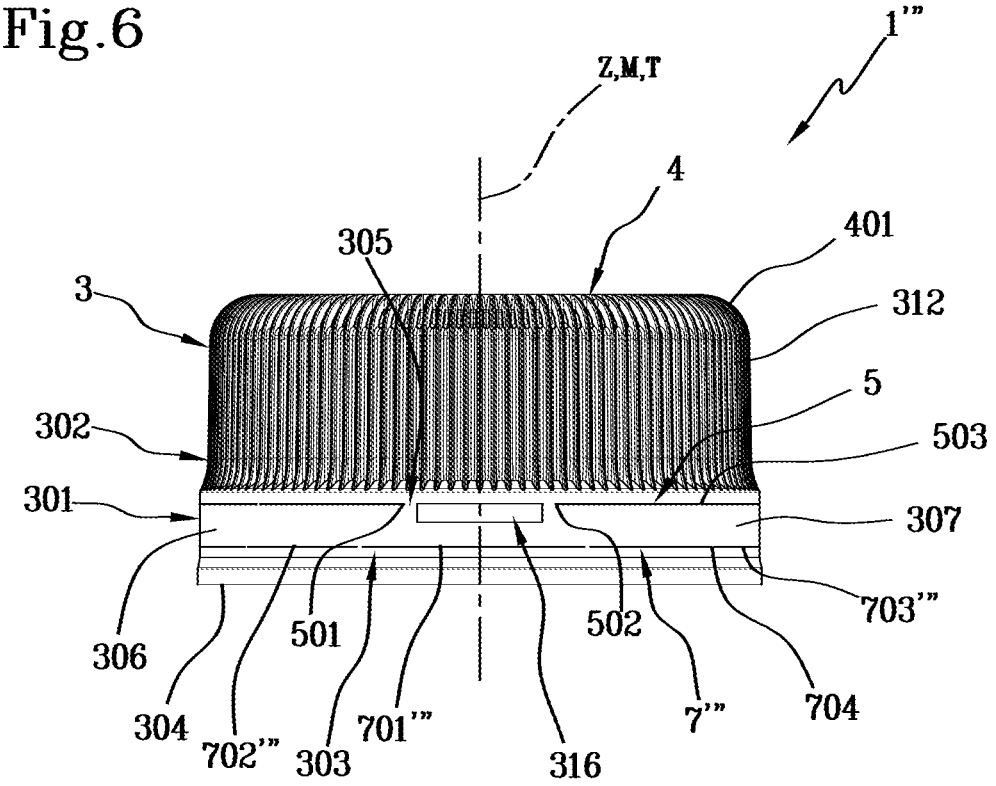
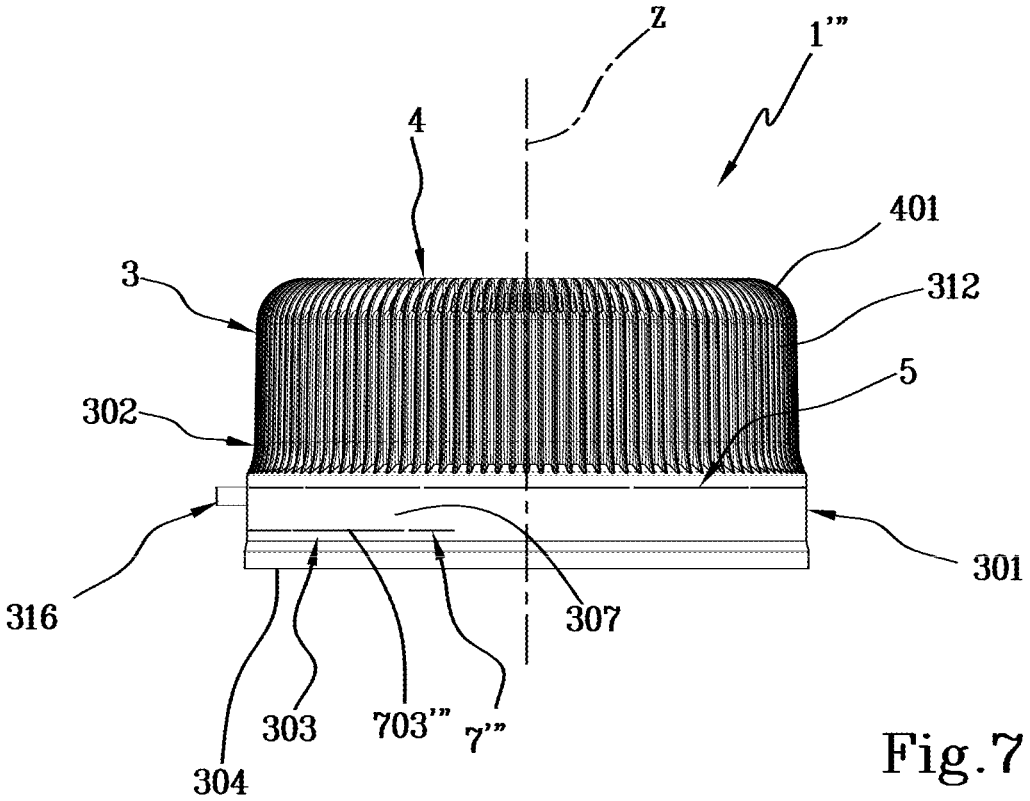
Fig.7

CAP FOR CONTAINER

This invention relates to a cap for a container.

In particular, the invention relates to a cap provided with a retaining ring, joinable to a container neck, the cap also being provided with a closing element which, after opening, remains connected to the retaining ring.

The cap is particularly, but not exclusively, suitable for bottles intended to contain liquid substances.

There are prior art caps for containers comprising a cup-shaped body provided with a transversal wall and a lateral wall extending around an axis, which are typically made of plastic material and are provided with a separating line made in the lateral wall to define a retaining ring and a closing element, which can removably engage with the neck, so as to open or close the container. The retaining ring is configured to remain anchored to a neck of the container. The closing element is provided with an inner thread structure, suitable for engaging with an outer thread structure of the neck, which extends around the axis in a spiral to allow the cap to be unscrewed from and screwed back onto the neck.

Along the separating line the breakable bridges are present, which are intended to be broken the first time the cap is opened. In fact, when the cap is opened for the first time and is unscrewed from the neck of the container, the closing element separates from the retaining ring along the separating line following breaking of the breakable bridges and in this way the retaining ring can remain joined to the neck of the bottle, while the closing element can be separated from the container. Then, the closing element can be screwed back onto the neck, to reclose the container and return the container to a closed condition.

The separating line can be made by cutting, or during moulding of the cap, and the shape of the separating line determines the way in which the closing element and the retaining ring separate following the first opening of the cap itself.

There are prior art caps in which the separating line is configured to extend circumferentially for the entire lateral wall in such a way that the closing element completely detaches from the retaining ring, at the moment of first opening of the cap. With these caps it may be the case that the user throws the closing element on the ground, deliberately or accidentally, whilst the container, together with the retaining ring joined to it, is correctly thrown in a waste bin. Obviously, this is unwanted behaviour.

To overcome this problem caps have been proposed in which the separating line is circumferentially interrupted to leave the closing element joined to the retaining ring in the cap open condition. In this case, the separating line extends between a first end and a second end which between them define a joining zone between the closing element and the retaining ring.

After the first opening of the cap, the closing element remains connected to the retaining ring and both remain connected to the neck of the bottle so that a user can rotate and shift the closing element between a closed condition, in which the closing element prevents access to the container and is screwed onto the thread and an open condition, in which the closing element is disengaged from the neck and is rotated and stably locked on itself, to allow access to the contents of the container.

In passing from the closed condition to the open condition, the user initially unscrews the closing element from the neck until the thread of the closing element is disengaged from the corresponding thread of the neck and then rotates the closing element around the joining zone, moving it away from the supply opening until it is stably locked on the neck. In passing from the open condition to the closed condition, vice versa, the user shifts the closing element laterally until it is disengaged from the neck and again positions it above the supply opening of the container, to be able to again engage it with the thread and screw it back onto the neck to close the container itself.

The latter operation can be particularly complicated, above all if the joining zone applies an axial traction on the closing element which makes it difficult for a user to couple the thread of the closing element to the thread of the neck, in order to be able to screw the closing element onto the neck itself.

In fact, the user may find him/herself forced to try multiple times to find the right balance between the axial traction applied by the joining zone and the need to correctly position, and if necessary even angle, the closing element relative to the outer thread structure of the neck, in order to be able to screw it onto it.

FR3106582 is a generic document belonging to the same technical sector as this invention.

One aim of the invention is to improve the prior art caps, in particular the container caps comprising a retaining ring intended to remain joined to a neck of the container and a closing element which can removably engage with the neck to allow a user to open or alternatively close the container.

A further aim is to provide a cap for a container, provided with a closing element which remains connected to the retaining ring, which additionally guarantees easy movement from the open condition to the closed condition.

According to one aspect of the invention, a cap for a container is provided according to claim 1 and the claims dependent on it.

The invention can be better understood and implemented with reference to the accompanying drawings, which illustrate several example, non-limiting embodiments of it, in which.

Figure 1:
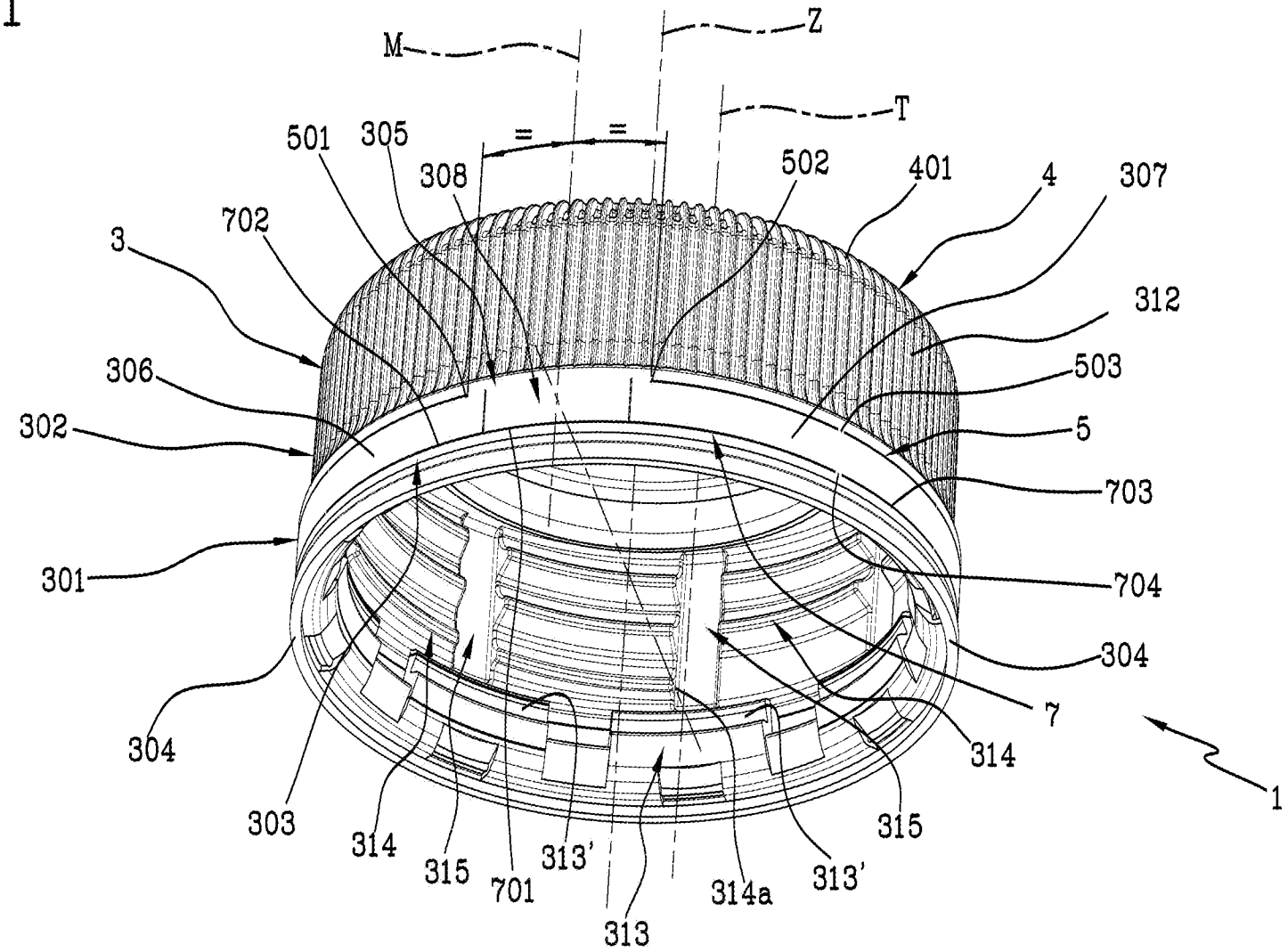
FIG. 1 is a perspective view of a closing cap for a container, in accordance with the invention, seen from the side of a free edge, which comprises a separating line and an incision line to define a closing element, a retaining ring and two connecting bands, in which a tab is present interposed between the two connecting bands and in which an inner thread structure is shown.
Figure 5:
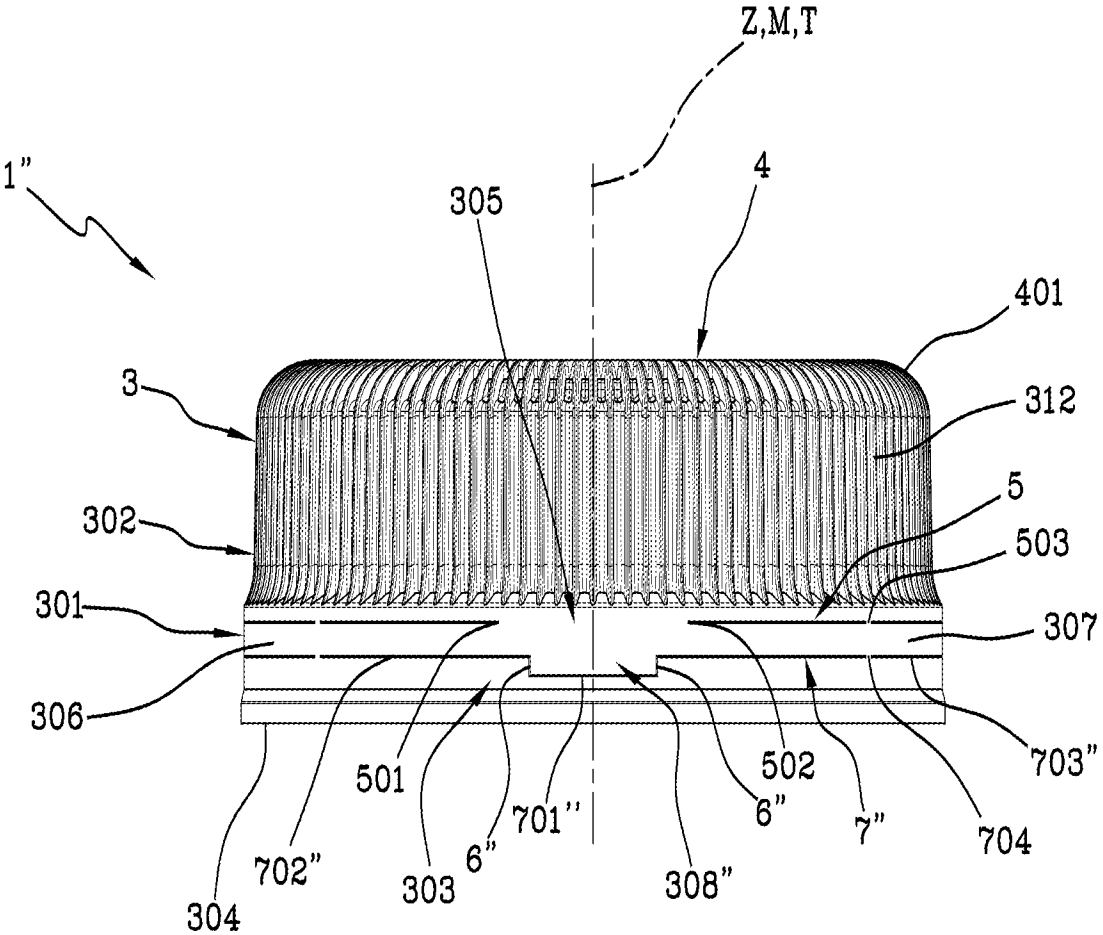

FIG. 5 shows a front view of a different embodiment of the cap of FIG. 1, in which the separating line, the incision line and the two connecting bands are present, and in which a tab is present interposed between the two connecting bands, a central stretch of the incision line, intended to form the end edge of the tab, projecting towards a free edge of the retaining ring, relative to lateral stretches of the incision line;

FIG. 6 shows a front view of another different embodiment of the cap of FIG. 1, in which the separating line, the incision line and the two connecting bands are present and in which a projection is present which projects from an outer surface of the cap transversally to the axis Z;

FIG. 7 is a side view of the cap of FIG. 6.

With reference to the accompanying figures, the numeral 1 denotes a cap for closing a container, not illustrated, in particular a bottle intended to contain a liquid substance such as a beverage.

It should be noticed that, in this description, the same reference numbers will be assigned to identical components.

The cap 1 is made of polymeric material. Any polymeric material suitable for moulding may be used to obtain the cap 1.

The cap 1 is shown in a condition in which the cap 1 is found when it leaves a cap production line and can be applied to a neck, not illustrated, of the container, in combination with it.

The cap 1 comprises a lateral wall 3 which extends around an axis Z, and a transversal wall 4 positioned at one end of the lateral wall 3, so as to close that end. The transversal wall 4 extends transversally, in particular perpendicularly, to the axis Z.

The axis Z is a central axis, of symmetry for the cap 1.

The transversal wall 4 may be flat, even though other shapes are theoretically possible. In the example illustrated, the transversal wall 4 has a substantially circular shape in plan view.

The lateral wall 3 and the transversal wall 4 define a cup-shaped body, suitable for receiving an end portion of the neck of the container, so that the cap 1 can close the self-same container.

In particular, the lateral wall 3 is connected to the transversal wall 4 by a connecting zone 401, which may be shaped, in cross section, like a bevelled edge or a circular connector.

The cap 1 comprises a separating line 5, which is provided on the lateral wall 3 to define a retaining ring 301, which is configured to remain anchored to the neck of the container.

The separating line 5 extends around the axis Z and is circumferentially interrupted so as to leave the retaining ring 301 and the closing element 302 joined by a joining zone 305. In detail, the separating line 5 extends between a first end 501 and a second end 502.

The separating line 5, on the lateral wall 3, defines not just the retaining ring 301, but also a closing element 302 removably engageable with the neck, so as to open or close the container. The closing element 302 is engageable for closing a supply opening, not illustrated, of the container.

The retaining ring 301 comprises a retaining portion 303, which is configured to internally engage with a stop ring of the neck, not illustrated, in such a way as to remain anchored to the neck.

The stop ring is an annular protuberance, which projects from an outer surface of the neck in a plane placed transversally to the axis Z.

The retaining portion 303 extends as far as a free edge 304 of the retaining ring 301, which delimits the retaining ring 301 on the opposite side to the transversal wall 4.

In other words, the retaining portion 303 is a lower portion of the retaining ring 301, and therefore of the cap 1, when the cap 1 is joined to the container and is configured to keep the retaining ring 301 anchored to the neck of the container.

The lateral wall 3 may be provided, on an outer surface thereof, with a plurality of knurling lines 312, extending parallel to the axis Z and suitable for facilitating gripping of the cap 1 by the user or by the capping machine which applies the cap 1 on the container to be closed.

The knurling lines 312 may be positioned in the closing element 302, but may also continue in the connecting zone 401 and/or in the retaining ring 301.

Figure 2:
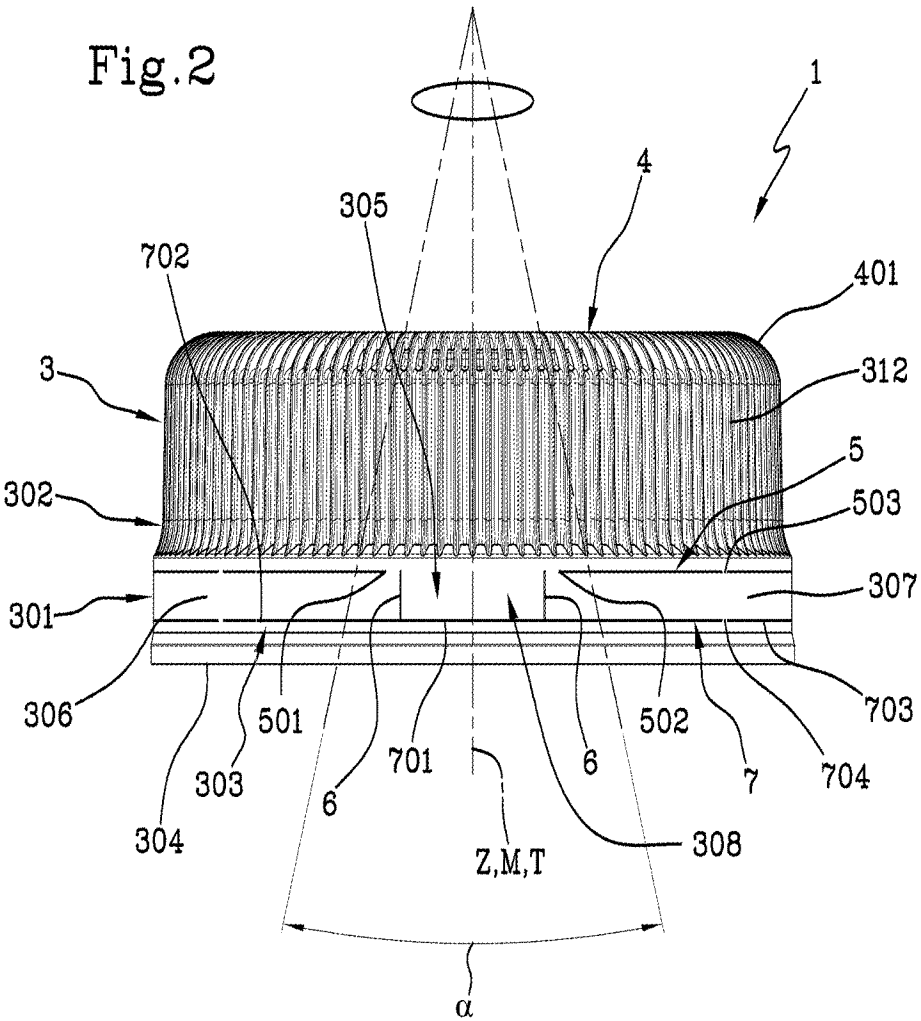
FIG. 2 shows a front view of the cap of FIG. 1, in which a central stretch of the incision line, intended to form an end edge of the tab, is aligned with lateral stretches of the incision line itself.

It should be noticed in FIG. 2 that the lateral wall 3 of the cap 1 comprises a cylindrical portion which extends as far as the connecting zone 401, on which the knurling lines 312 are made, a widened portion with diameter greater than the cylindrical portion, which extends as far as the free edge 304 of the retaining ring 301 and a connecting portion positioned between the cylindrical portion and the widened portion. The knurling lines 312 are provided on the connecting zone, but not in the widened portion, which is externally delimited by a smooth outer surface, that is to say, it can be free of knurling lines 312. However, that is not necessary, since the knurling lines 312 could also extend on the widened portion.

In the connecting zone the knurling lines 312 may be interrupted to highlight a mark, not illustrated, which is optically recognisable relative to the knurling lines 312, so that optical inspection systems for the cap 1, which are present in cap 1 production lines, can optically tell the difference between the mark and the knurling lines 312.

An incision line 7 is provided on the lateral wall 3 and defines, together with the separating line 5, at least one connecting band for connecting the closing element 302 and the retaining portion 303 to each other.

The separating line 5 and the incision line 7 can be made as cut lines by means of a cutting operation on a concave body obtained by moulding, or by means of appropriate mould conformation.

The cut lines may pass through the entire thickness of the lateral wall, or not pass through if the thickness of the lateral wall 3 is to be only partly cut. Preferably, the separating line 5 and the incision line 7 are made by means of through cuts passing through an entire thickness of the lateral wall 3.

Optionally, along the separating line 5 there may be a plurality of breakable bridges 503, whilst along the incision line 7, there may be a plurality of breakable elements 704, these breakable bridges 503 and breakable elements 704 being intended to break the first time the cap 1 is opened. The breakable elements 704 may be positioned in angularly offset positions around the axis Z relative to the breakable bridges 503.

To allow breaking of the breakable bridges 503, or of the breakable elements 704, the retaining ring 301 is internally provided with an engaging element 313 shown in FIG. 1, suitable for engaging with the stop ring of the neck. The engaging element 313 is configured to abut against the stop ring in order to prevent axial movements of the retaining ring 301, away from the neck, when the closing element 302 is moved away from the neck.

In detail, it is the retaining portion 303 of the retaining ring 301 which is provided with the engaging element 313, in such a way that it is kept anchored to the stop ring even when the closing element 302 is in the open condition and is locked at a distance from the neck and from the supply opening.

The engaging element 313 is shaped like an annular element which is bent around the free edge 304 inwards towards the inside of the retaining portion 303. The engaging element 313 is shown in FIG. 1 as an interrupted annular element. In fact, as shown in FIG. 1, there may be a plurality of bent elements 313' shaped like flaps, which project from the free edge 304 and are bent inwards towards the inside of the retaining portion 303 to form the engaging element 313.

That is not necessary and in fact, according to an embodiment not illustrated, that annular element may even be continuous.

Alternatively, according to another embodiment not illustrated, the engaging element 313 may be shaped like a continuous or interrupted protuberance, which from an inner surface of the retaining portion 303 projects towards the axis Z to engage with the stop ring.

As indicated in more detail below, concerning the position of the incision line 7 relative to the separating line 5 different variants of the cap 1 may be identified as regards, for example, the position of the connecting band or the number of connecting bands present.

The cap 1 additionally comprises an inner thread structure 314, positioned on the inside of the lateral wall 3 of the closing element 302 for removably coupling the closing element 302 to the neck of the container.

In detail, the inner thread structure 314 is intended to couple to an outer thread structure of the neck, not illustrated.

The inner thread structure 314 extends in a spiral around the axis Z of the cap 1 starting from a start 314*a*.

The start 314*a* of the inner thread structure 314 is positioned near the separating line 5.

It should be noticed that the inner thread structure 314 comprises at least two venting grooves 315 which extend axially and interrupt the inner thread structure 314.

The cap 1, having the venting grooves 315 is particularly suitable for use as a closure for containers intended to contain sparkling beverages, or in any case products which are pressurised or in which pressure may build up over time (for example fermentable beverages).

In fact, if the inner thread structure 314 of the cap 1 and the outer thread structure of the neck are provided respectively with a plurality of venting grooves 315 and with a plurality of venting channels, not illustrated, which extend axially and which pass through and interrupt the respective threads, a gradual release of the gas contained in the container during removal of the cap 1 from container can be guaranteed.

However, it should be noticed that the venting grooves 315 may even be absent in the cap 1, if the latter is not intended to be used as a closure for containers for sparkling beverages, pressurised products or those in which pressure may build up.

The inner thread structure 314 extends as far as an end (not illustrated) positioned near the transversal wall 4.

It should be noticed that the inner thread structure 314 may be single-threaded, that is to say, may comprise a single spiral curved thread which extends from the start 314*a* to the end, or it may be double-threaded, or triple-threaded, that is to say, it may comprise respectively two, or three separate spiral curved threads, each of which may extend continuously starting from a respective origin to a respective destination.

If the inner thread structure 314 is at least double-threaded, the start 314*a* of the inner thread structure 314 coincides with a first origin of the first thread, or with a second origin of the second thread, that is to say, with the origin positioned nearest to the separating line 5.

Advantageously, according to this invention a median line M of the joining zone 305, along a line parallel to the axis Z, is positioned circumferentially within a reference angular portion α.

That reference angular portion α has an amplitude which is less than or equal to 60° and has a bisector plane BP which is defined by a first axis T, parallel to the axis Z, which is placed at the start 314*a* of the inner thread structure 314, and a second axis B which is diametrically opposed to the first axis T.

The median line M of the joining zone 305 defines two portions with equal circumferential extent between the first end 501 and the second end 502 of the of the joining zone 305.

In other words, if we now consider a prism shaped like a slice of cake having as bases two circular sectors with angular extent equal to 60°, parallel to each other, having as the vertex the axis Z, which is positioned in the cap 1 in such a way as to have as the bisector plane BP that defined by the first axis T and by the second axis B, the median line M may be circumferentially positioned in the lateral wall 3 within the reference angular portion α, which is contained in the above-mentioned prism.

According to one embodiment of the cap 1, preferably the reference angular portion α has an amplitude which is less than or equal to 40°.

Figure 3:
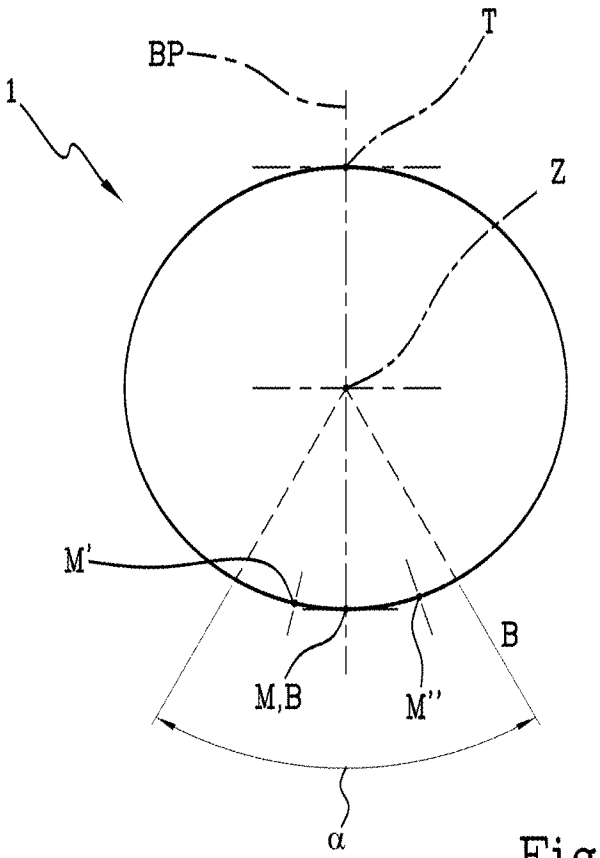
FIG. 3 shows a schematic view of the cap of FIG. 1, seen from the side of a transversal wall, opposite to the free edge, showing a median line M of a joining zone, a first axis T, a second axis B, which are all three parallel to an axis Z around which a lateral wall of the cap is positioned.

It should be noticed that the reference angular portion α extends around the axis Z and was shown in FIG. 3. However, in this text, the term "angular portion" means a portion of the lateral wall 3 which extends circumferentially for a respective reference angle α, identified around the axis Z and shown in FIG. 3 using a cross-section plane perpendicular to the axis Z.

In other words, the reference angular portion α, is not necessarily identified by an angle which lies in a plane, but may even be identified by an angle defined between two planes and, in this case, the reference angular portion α also extends axially, that is to say, parallel to the axis Z, for a predetermined dimension of the lateral wall 3.

In FIGS. 1 and 2, the median line M is positioned in the bisector plane BP, that is to say, it coincides with the second axis B, diametrically opposed to the first axis T.

However, as is schematically shown in FIG. 3, there may be other embodiments of the cap 1 having for example a median line M', or a median line M", which do not lie in the bisector plane BP previously identified, but are in any case contained in the reference angular portion α previously defined.

Thanks to the fact that the median line M of the joining zone 305 is substantially diametrically opposed to the start 314*a* of the inner thread structure 314 (or in any case may extend within the reference angular portion α), the engagement between the start 314*a* of the inner thread structure 314 and the outer thread structure of the neck occurs in a position which is substantially diametrically opposed to the joining zone 305. A user, who wants to return the cap 1 to the closed condition after having opened it and has placed the closing element 302 over the supply opening, is in the condition in which the joining zone 305, which keeps the closing element 302 connected to the retaining ring 301, applies a direct tension along the axis Z in a region of the cap 1 which extends circumferentially even beyond the joining zone 305. Since the engagement between the inner thread structure 314 and the outer thread structure occurs on the opposite side to the median line M of the joining zone 305, or in any case within the reference angular portion α, it is guaranteed that the user will be able to freely angle the closing element 302 to search for that engagement without the movement being prevented by the axial tension of the joining zone 305. Therefore, for the user reclosing of the container after having opened it is made easier.

As already indicated, at least one connecting band is present, which stably connects the closing element 302 to the retaining portion 303 when the cap 1 is in the open condition, and that connecting band is made between the separating line 5 and the incision line 7.

Thanks to the connecting band, the possibility of the closing element 302 being thrown on the ground separately from the container is prevented and the closing element 302 can be stably locked on the neck of the container when the cap 1 is in the open condition.

If we now consider the cap 1, it can be seen how the at least one connecting band comprises a first connecting band 306 and a second connecting band 307 for connecting the closing element 302 and the retaining portion 303 to each other, the connecting bands being defined by the separating line 5 together with the incision line 7.

The incision line 7 comprises a first lateral stretch 702 and a second lateral stretch 703, which at least partly define the first connecting band 306 and the second connecting band 307. The first connecting band 306 is defined between the first lateral stretch 702 and a first part of the separating line 5, which extends from the first end 501 of the separating line 5.

The second connecting band 307 is defined between the second lateral stretch 703 and a second part of the separating line 5 which extends from the second end 502 of the latter.

The incision line 7 extends between the separating line 5 and the free edge 304 of the retaining ring 301.

Therefore, the retaining ring 301 extends between the separating line 5 and the free edge 304 and may be delimited by a cylindrical or frustoconical outer surface.

Preferably, the separating line 5 is parallel to the free edge 304.

The first connecting band 306 and the second connecting band 307 are therefore positioned in the retaining ring 301 and extend from the joining zone 305 to the retaining portion 303.

The first connecting band 306 and the second connecting band 307 are positioned circumferentially on opposite sides of the joining zone 305.

It should be noticed that the incision line 7 has an angular extent, measured around the axis Z, which is greater than the angular distance (also measured around the axis Z) between the first end 501 and the second end 502 of the separating line 5, that is to say, the angular extent of the joining zone 305.

In addition, the joining zone 305 extends circumferentially in the angular extent of the incision line 7.

Preferably, the median line M of the joining zone 305 and centre line of the incision line 7 are coincident, along a line parallel to the axis Z and in this case the first connecting band 306 and the second connecting band 307 are positioned symmetrically relative to the bisector plane BP containing the axis Z and the median line M of the joining zone 305. In this case, the first connecting band 306 and the second connecting band 307 have the same length.

However, the median line M of the joining zone 305 and the centre line of the incision line 7 may be angularly near, but not coincident and in that case the connecting bands 306, 307 may have different lengths.

The first lateral stretch 702 and the second lateral stretch 703 of the incision line 7 are both perpendicular to the axis Z and are aligned. However, in an embodiment not illustrated, the two lateral stretches 702 and 703 could be slightly angled relative to each other and have different inclinations, not necessarily parallel to each other.

The first lateral stretch 702 and the second lateral stretch 703 preferably extend, in a first plane (not illustrated) parallel to a separating plane (not illustrated) containing the separating line 5, the first plane being transversal to the axis Z, in particular perpendicular to the axis Z.

When the cap 1 is in the open condition, the first lateral stretch 702 and the second lateral stretch 703 respectively define a first free lower edge, not illustrated, and a second free lower edge, not illustrated, of the connecting bands 306, 307.

In addition, the first lateral stretch 702 and the second lateral stretch 703 also define a first free upper edge, not illustrated, and a second free upper edge, not illustrated, of the retaining portion 303.

The incision line 7 comprises a central stretch 701 which is interposed between the first lateral stretch 702 and the second lateral stretch 703 of the incision line 7 and defines an end edge which in the closed condition is facing the retaining portion 303 and is configured to be directed, when the cap 1 is in the open condition, towards the neck, or towards the supply opening, of the container.

In the cap 1 of FIGS. 1 and 2, the retaining ring 301 comprises a tab 308 so that, when the closing element 302 is in an open condition, and the connecting bands 306, 307 keep the closing element 302 connected to the retaining ring 301, the tab 308 can rest on the neck.

The central stretch 701 defines the end edge of the tab 308, when the cap 1 is in the open condition.

Two cuts 6 are provided on the lateral wall 3 which define the respective lateral edges of the tab 308 and they are formed by cut lines passing through an entire thickness of the lateral wall 3.

The central stretch 701 of the incision line 7 is positioned between the cuts 6 and is also interposed between the first lateral stretch 702 and the second lateral stretch 703 of the incision line, in particular the central stretch 701 is positioned between lower ends of the cuts 6.

If the central stretch 701 as well as the two lateral stretches 702 and 703 are aligned with each other and in the single plane positioned transversally, in particular perpendicularly, to the axis Z, the end edge of the tab 308 is aligned with the first free lower edge, and with the second free lower edge, of the connecting bands 306, 307.

It should be noticed that the tab 308 is connected to the lateral wall 3 by a hinge line (not illustrated), around which the tab 308 may optionally bend so that it rests on the neck near the stop ring.

It should be noticed that the hinge line is a virtual line which in the lateral wall 3 defines a zone around which the tab 308 may optionally bend, which may be positioned near the separating line 5, depending on the height of the tab 308, or near the free edge 304.

The cuts 6 have upper ends, directed towards the transversal wall 4, between which the hinge line is defined.

In the cap 1 of FIGS. 1 and 2, the hinge line is near the separating line 5, and is in particular substantially aligned with it.

If we consider a height of the tab 308, this is determined by the height of the cuts 6.

When the closing element 302 passes from the closed condition to the open condition, the joining zone 305 deforms and is overturned relative to the neck, so that the end edge of the tab 308 can rest on the neck itself.

Figure 4:
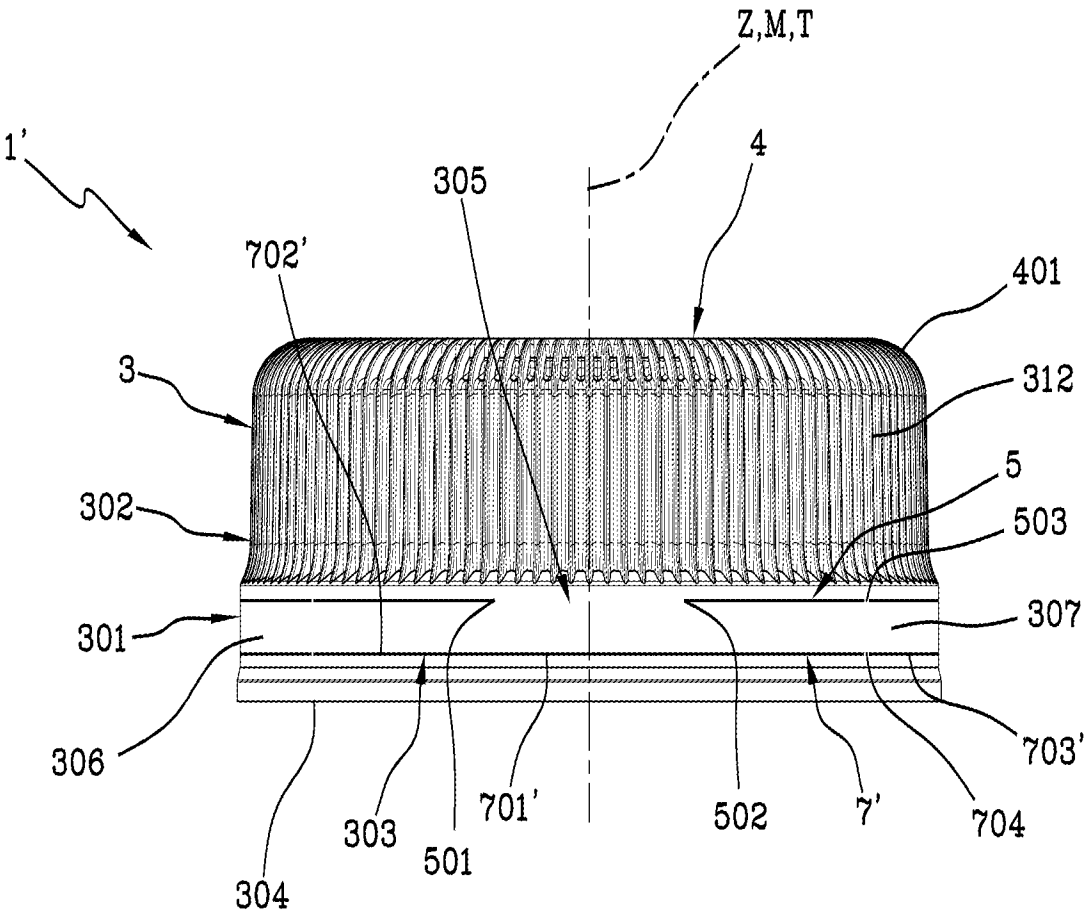
FIG. 4 shows a front view of another embodiment of the cap of FIG. 1, in which the separating line, the incision line and the two connecting bands are present, and in which the tab is absent.

In accordance with one variant 1' of the cap shown in FIG. 4, everything previously said for the cap 1 still applies, but the tab is absent, since the cuts 6 are absent, and the cap 1' comprises an incision line 7' provided with a central stretch 701', and with lateral stretches 702' and 703'.

The central stretch 701' of the incision line 7', interposed between the first lateral stretch 702' and the second lateral stretch 703', defines an end edge configured to be directed, when the cap 1' is in the open condition, towards the neck, or towards the supply opening of the container. The central stretch 701' is facing the joining zone 305.

For the cap 1' everything said for the cap 1 also applies with reference to the positioning of the median line M of the joining zone 305 within the reference angular portion α.

However, unlike the cap 1, in the cap 1' the connecting bands 306 and 307 may deform when passing from the closed condition to the open condition and when the closing element is in the open condition.

In fact, if, in each connecting band 306, 307, we consider a first strip, directed towards the closing element 302 and a second strip directed towards the free edge 304, the first strip can expand radially, without being subjected to a substantial twisting whilst the second strip can in contrast twist in order to pass below the first strip, interposing itself between the first strip and the outer surface of the neck. In this way, when the end edge of the central stretch 701' is positioned towards the supply opening of the container, the second strip of the connecting bands 306 and 307 is twisted and is below the first strip. This twisting helps to keep the closing element 302 stably fixed in the same position in the open condition.

According to one variant 1" of the cap shown in FIG. 5, everything previously said for the cap 1 still applies, but the cap 1" comprises a tab 308", which differs from the tab 308 shown in FIGS. 1 and 2 due to the fact that it has an incision line 7" which comprises a central stretch 701" which extends in a second plane, parallel to the separating plane which is interposed between the first plane and the free edge 304 of the retaining ring 301, to define an end edge of the tab 308" which projects relative to the connecting bands 306, 307.

In fact, whilst a first lateral stretch 702" and a second lateral stretch 703" are similar to those of FIGS. 1 and 2, in the incision line 7" the central stretch 701" present is nearer to the free edge 304 to define the tab 308" whose end edge projects relative to the connecting bands 306, 307.

Preferably, the central stretch 701" lies in a second plane parallel to the separating plane and parallel to the first plane.

In this case too, the height of the tab 308" is determined by the height of the cuts 6, which extend from the central stretch 701" until they intercept the lateral stretches 702", 703".

In this way, in the cap 1", the hinge line is substantially aligned with the first lateral stretch 702" and with the second lateral stretch 703" of the incision line 7".

In one embodiment not illustrated, the cuts 6 may continue in the joining zone 305, and optionally also in the closing element 302, to give the tab 308" greater flexibility and a greater height.

In fact, whilst the tab 308 of FIGS. 1 and 2 is made in the height of the connecting bands 306, 307, the tab 308" of FIG. 4 is made exclusively as an external part, projecting relative to the first connecting band 306 and the second connecting band 307.

Unlike the cap 1, and like in the cap 1', the connecting bands 306 and 307 of the cap 1" may deform when the closing element 302 is in the open condition, or when passing from the closed condition to the open condition, twisting as previously described for the cap 1'.

For the cap 1" everything said for the cap 1 also applies with reference to the positioning of the median line M of the joining zone 305 within the reference angular portion α.

In accordance with one variant 1'" of the cap shown in FIGS. 6 and 7, everything already said for the cap 1 still applies, but the cap 1'" differs from the cap 1 due to the fact that the outside of the joining zone 305 is provided with a projection 316, which projects from the joining zone 305 and is positioned between the separating line 5 and an incision line 7'", so that, when the closing element 302 is in the open position and the connecting bands 306, 307 keep the closing element 302 connected to the retaining ring 301, the end edge defined by a central stretch 701'" of the incision line 7'" is directed, in the open position, towards the supply opening of the container and the projection 316 is resting on the neck.

The projection 316 projects from the joining zone 305 transversally to the axis Z.

The projection 316 operates in conjunction with the overturning of the joining zone 305 and can render stable and lock the closing element 302 on the neck, preventing the connecting bands 306 and 307 from performing a movement rotating in the opposite direction.

In this case, unlike for the cap 1' of FIG. 4 the connecting bands 306 and 307 cannot twist and deform when the closing element 302 is in the open condition, despite having no tab, since the projection 316 is resting on the neck and prevents twisting of the connecting bands 306, 307.

It should be noticed that the projection 316 may advantageously be applied even to one of the caps 1 and 1" previously described, for example the projection 316 could be positioned in the tab 308, or 308".

For the cap 1'" everything said for the cap 1 also applies with reference to the positioning of the median line M of the joining zone 305 within the reference angular portion α.

According to a further variant not illustrated, the separating line 5 is positioned between an incision line and the free edge 304. In this case, the retaining ring 301 coincides with the retaining portion 303 since the connecting bands 306, 307 are made in the closing element 302.

The joining zone 305, defined between the first end 501 and the second end 502 of the separating line 5, is joined to the retaining portion 303.

The first connecting band 306 and the second connecting band 307, when the cap passes from the closed condition to the open condition, thereby adopt a trapezium-shaped configuration, not illustrated, but the smaller base of the trapezium is directed towards the free edge 304, whilst the larger base of the trapezium, defined by the incision line 7, is directed towards the transversal wall 4.

In other words, the central stretch 701 of the incision line 7 is facing the closing element 302, and in detail, is positioned facing an end edge of the closing element 302.

Therefore, it should be noticed that, advantageously, in all of the embodiments of the cap 1, 1', 1", or 1'" according to this invention, shown in the accompanying figures or even just described, the median line M of the joining zone 305, on the lateral wall 3 of the cap 1, 1', 1", or 1'", is positioned substantially diametrically opposed to the first axis T, positioned at the start **314*a* of the inner thread structure 314**, that is to say, it is positioned within the reference angular portion α having an amplitude less than or equal to 60°, whose bisector plane BP is defined by the first axis T and by the second axis B, diametrically opposed to the first axis T.

That guarantees that the user finds it easier to pass to the closed condition since it is easier to engage the inner thread structure 314 of the cap 1, 1', 1", or 1'" with the outer thread structure of the neck because the start **314*a* of the inner thread structure 314 is in the portion of the closing element 312** which can be angled the most relative to the neck of the container.

In use, the cap 1, 1', 1", 1'" is applied on the neck of the container in the closed condition. The cap 1, 1', 1", 1'" is positioned in such a way that the engaging element 313 provided inside the retaining ring 301, in particular on the retaining portion 303 is below the stop ring which is present on the neck.

When the user wishes to open the container for the first time, the user grips the closing element 302 and rotates the closing element 302 around the axis Z, in order to unscrew the closing element 302 from the neck. Initially, the closing element 302 and the retaining ring 301 are rotated together around the axis Z, and they simultaneously move together in a direction parallel to the axis Z, away from the neck, the inner thread structure 314 of the cap 1, 1', 1", 1'" engaging with the corresponding outer thread structure of the neck of the container.

This occurs until the engaging element 313 of the retaining portion 303 abuts against the stop ring provided on the neck. At this point, the stop ring prevents the retaining portion 303 from rising further along the axis Z, acting as a stop for the movement of the retaining portion 303, and therefore of the retaining ring 301, away from the neck.

The closing element 302, which is unscrewed by the user, continues to move along the axis Z away from the neck. The breakable bridges 503 are thereby tensioned, until causing them to break. The closing element 302 consequently separates from the retaining ring 301 along the separating line 5, but remains joined to the retaining ring 301 at the joining zone 305.

If the user continues to unscrew the closing element 302, so as to move the closing element 302 along the axis Z to remove it from the neck, the first connecting band 306 and the second connecting band 307 deform since they extend between the retaining portion 303, locked by the stop ring, and the joining zone 305, fixed and joined to the closing element 302, which moved away from the stop ring and was lifted upwards.

If the tab 308, or 308", is present, it also moves away from the stop ring whilst the first connecting band 306 and the second connecting band 307 are pulled upwards.

If present, the breakable elements 704 of the joining zone are thereby tensioned, until causing them to break.

Then, the first connecting band 306 and the second connecting band 307 are spaced apart from both the closing element 302 and the retaining portion 303 and remain joined to each other in the joining zone 305.

The first connecting band 306 and the second connecting band 307 thus adopt a trapezium-shaped configuration, not illustrated. If the tab 308, or 308", is present it may be positioned in the smaller base of the trapezium.

If the first connecting band 306 has the same length as the second connecting band 307, the trapezium which may be described by them is of the isosceles type. If, in contrast, the connecting bands 306, 307 have different lengths, they will adopt a scalene trapezium type shape. As regards the position of the tab 308, or 308" in the joining zone 305, it will be possible for the tab 308, or 308" to be positioned centrally or laterally.

The first connecting band 306 remains joined to the retaining portion 303 at an outer end of the first lateral stretch 702 of the incision line 7. Similarly, the second connecting band 307 remains joined to the retaining portion 303 at an outer end of the second lateral stretch 703 of the incision line 7, the outer end of the first lateral stretch 702 and the outer end of the second lateral stretch 703 externally delimiting the incision line 7 circumferentially.

If the first connecting band 306 and the second connecting band 307 are positioned in a configuration angled relative to the retaining portion 303 and they converge in the joining zone 305, the tab 308, or 308" extends along an axis which is parallel to the axis Z.

Continuing to unscrew the closing element 302, the latter disengages from the outer thread structure of the neck, so that the container can be opened. In contrast, the retaining portion 303 of the retaining ring 301 remains anchored to the neck.

The joining zone 305 defines a hinge band, which keeps the closing element 302 connected relative to the neck and around which the closing element 302 can rotate moving away from the neck and which at the same time deforms to allow rotation of the closing element 302 relative to the neck.

In other words, after having disengaged from the neck, the closing element 302 can be rotated around the joining zone 305.

In addition, the joining zone 305, the first connecting band 306, the second connecting band 307 and optionally the tab 308, 308" are joined to each other and define a hinge arrangement which has a capacity for movement, in an axial direction, noticeably greater than the capacity for movement which would be allowed by the joining zone 305 alone.

The hinge arrangement is a part of the retaining ring 301 which is interposed between the retaining portion 303 of the retaining ring 301 and the closing element 302.

Now considering the tab 308 of the cap 1, the hinge band comprises a first hinge element and a second hinge element which are at least partly defined in the joining zone 305 respectively between the first end 501 and the second end 502 of the separating line 5 and the respective upper ends of the cuts 6, that is to say, the ends of the hinge line.

The first hinge element and the second hinge element are positioned at the sides of the tab 308 and are configured to deform when passing to the open condition.

That deformation affects exclusively the first hinge element and the second hinge element but not the connecting bands 306, 307, which can therefore remain substantially undeformed and do not twist in the open condition.

In the case of the cap 1' of FIG. 4 in which the tab is absent, in contrast, the connecting bands 306 and 307 can deform since, as previously described, the first strip directed towards the closing element 302 can expand radially, without being subjected to a substantial twisting whilst the second strip directed towards the free edge 304 in contrast can twist to pass below the first strip. This twisting of the connecting bands 306, 307, allows the closing element 302 to be kept stably fixed in the same position in the open condition.

In the case of the cap 1" of FIG. 5, in which the tab 308" is present, shaped like an external part projecting relative to the connecting bands 306, 307, the connecting bands 306 and 307 of the cap 1" can deform when the closing element 302 is in the open condition by twisting, just as was previously described for the cap 1'.

However, in the presence of the tab 308, or 308", when the cap is in the open condition, the end edge of the tab 308, 308", intercepts the neck of the container and can be placed resting on the neck to prevent the closing element 302 from being able to rotate around it.

For example, the tab 308, or 308", can rest in the outer zone of the neck located between the stop ring and a lower thread of the outer thread structure, or on the thread structure itself, depending on the shape of the retaining ring 301, and/or of the stop ring of the neck and/or the height of the tab 308, or 308".

The end edge of the tab 308, 308" becomes directed towards the supply opening of the container and the tab 308, 308" prevents the closing element 302 from being able to accidentally rotate towards the neck and around it.

In the case of the cap 1''' of FIGS. 6 and 7, in which the projection 316 is present, in the open condition, the connecting bands 306 and 307 can bend but are not subjected to complete twisting like in the cap 1' of FIG. 4, due to the presence of the projection 316 which rests on the neck and prevents further twisting of the connecting bands 306 and 307.

In fact, the projection 316 rests on the neck of the container and allows the closing element 302 to be kept stably fixed in the open condition without the need for the second strip to have to twist below the first strip.

When a user wants to close the container again, in order to be able to completely disengage the tab 308, or 308", or the projection 316, from the neck of the container, the closing element 302 must be moved further away.

In this way the closing element 302 can then be rotated so that it is above the supply opening of the container. In this condition, the first connecting band 306 and the second connecting band 307 are again positioned in a configuration angled relative to the retaining portion 303 and they converge in the joining zone 305, to which the closing element 302 is joined, again adopting the trapezium-shaped configuration.

To screw the cap 1, 1', 1" 1''' back onto the neck, the user must engage the inner thread structure 314 of the closing element 302 on the neck, starting from the start 314*a* which is located near the separating line 5.

Thanks to the fact that said start 314*a* is substantially diametrically opposed to the median line M of the joining zone 305, that is to say, the median line M is positioned around the lateral wall 3 within the reference angular portion $\alpha$ equal to 60°, preferably 40°, whose bisector plane BP is defined by the first axis T and by the second axis B, which is diametrically opposed to B, the user engaging the inner thread structure 314 of the closing element 302 with the outer thread structure of the neck is made easier since at the first axis T, that is to say, at the start 314*a* of the inner thread structure 314, it is possible to use the maximum freedom of positioning in space of the closing element 302.

The caps 1, 1', 1" and 1''' previously described are made of plastic material, for example polypropylene (PP) or polyethylene (PE).

If PE is used, its density may range from low density to high density. In particular, it is possible to use high density polyethylene (HDPE).

The high density polyethylene (HDPE) used to make the caps previously described may have the following properties:

density variable between 950 and 968 kg/m3;

melt index variable from 0.3 to 20 g, in the following measuring conditions: 10 minutes, 190° C., 2.16 kg;

molecular weight distribution wide, or narrow, or unimodal, or multimodal.

If PP is used, that material may be in the form of a homopolymer, or heterophasic copolymer, or even statistical copolymer.

The melt index of PP may vary from 2 to 20 g, in the following measuring conditions: 10 minutes, 230° C., 2.16 kg.

This invention is advantageously applicable to caps 1, 1', 1", 1''' which are suitable for use, for example, on necks in the following list, each neck being associated with a respective code which identifies the name of the neck, the diameter of the outer surface of the neck, and the diameter of the supply opening of the neck, in accordance with the nomenclature of CETIE (www.cetie.org) or ISBT (www.bev-ech.org).

For each code, if the neck is also a European standard, the reference number is also provided.

GME30.39 25/22 mm
GME30.28 26/22 mm DIN EN 16594:2016
GME30.38 26/22 mm
GME30.37 26/22 mm
GME30.40 26/22 mm
GME30.24 27/22 mm EN 16067:2012
PCO1881 28/22 mm
PCO1810 28/22 mm
GME30.26 29/25 mm EN 16592:2015
GME30.21 30/25 mm EN 16064:2012
GME30.31 32/26 mm
GME30.36 32/27 mm
GME30.30 33/28 mm
GME30.25 38/33 mm
GME30.29 38/32 mm

The invention claimed is:

1. A closing cap (1; 1'; 1"; 1''') for a container, comprising a lateral wall (3) extending around an axis (Z) and a transversal wall (4) positioned at one end of the lateral wall (3), a separating line (5) being provided on the lateral wall (3) to define a retaining ring (301), which comprises a retaining portion (303) which extends as far as a free edge (304) of the retaining ring (301) and is configured to internally engage with a stop ring of a neck of the container in such a way as to remain anchored to the neck, and a closing element (302) removably engageable with the neck, so as to open or close the container; the separating line (5) being circumferentially interrupted to define in the lateral wall (3) a joining zone (305) in which the retaining ring (301) and the closing element (302) are joined; the closing cap comprising an inner thread structure (314) positioned on the inside of the lateral wall (3) to engage with an outer thread structure of the neck and removably couple the closing element (302) to the neck of the container, the inner thread structure (314) extending in a spiral around the axis (Z) starting from a start (314*a*) placed near the separating line (5), wherein a median line (M) of the joining zone (305), along a line parallel to the axis (Z), is positioned circumferentially within a reference angular portion ($\alpha$), wherein said reference angular portion ($\alpha$) has an amplitude which is less than or equal to 60° around the axis (Z) and has a bisector plane (BP) which is defined by a first axis (T), parallel to the axis (Z), placed at the start (314*a*) of the inner thread structure (314) and a second axis (B) which is diametrically opposed to the first axis (T).

2. The closing cap (1; 1'; 1"; 1''') according to claim 1, wherein said reference angular portion ($\alpha$) has an amplitude which is less than or equal to 40°.

3. The closing cap (1; 1'; 1"; 1''') according to claim 1, wherein the inner thread structure (314) comprises at least two venting grooves (315) which extend axially and interrupt the inner thread structure (314).

4. The closing cap (1; 1'; 1"; 1'''') according to claim 1, wherein the inner thread structure (314) comprises a single thread which extends in a spiral and extends from the start (314*a*) near the separating line (5) to an end placed near the transversal wall (4); or wherein the inner thread structure (314) comprises at least two threads which extend in spirals, the first thread extending from the start near the separating line (5) to an end placed near the transversal wall (4), the second thread extending from a further start near the separating line (5) to a further end placed near the transversal wall (4).

5. The closing cap (1; 1'; 1"; 1"") according to claim 1, wherein the closing cap comprises an incision line (7; 7'; 7"; 7"), which is also provided on the lateral wall (3) to define, together with the separating line (5) at least one connecting band (306; 307) for connecting the closing element (302) and the retaining portion (303) to each other.

6. The closing cap (1; 1'; 1"; 1'") according to claim 5, wherein the at least one connecting band (306; 307) further comprises a first connecting band (306) and a second connecting band (307) which are defined between the separating line (5) and the incision line (7; 7'; 7"; 7"), and wherein the incision line (7; 7'; 7"; 7") comprises a first lateral stretch (702; 702'; 702"; 702"") and a second lateral stretch (703; 703'; 703"; 703'"), which define respectively with a first part of the separating line (5), which extends from a first end (501) of the separating line (5), the first connecting band (306) and with a second part of the separating line (5), which extends from a second end (502) of the of the separating line, the second connecting band (307).

7. The closing cap (1; 1'; 1"; 1'") according to claim 6, wherein the incision line (7; 7'; 7"; 7'") is positioned between the separating line (5) and the free edge (304) and comprises a central stretch (701; 701'; 701"; 701'"), positioned between the first lateral stretch (702; 702'; 702"; 702"") and the second lateral stretch (703; 703'; 703"; 703"); the central stretch (701; 701'; 701"; 701'") having an end edge configured to be directed, when the closing cap is in the open condition, towards the neck, or towards the supply opening, of the container.

8. The closing cap (1; 1") according to claim 5, wherein the closing cap (1; 1") comprises a tab (308; 308") whose end edge is formed by the central stretch (701; 701") of the incision line (7; 7") and whose lateral edges are formed by two cuts (6; 6") which extend from the central stretch (701; 701") towards the closing element (302), the cuts (6; 6") being formed by through cuts passing through an entire thickness of the lateral wall (3).

9. The closing cap (1) according to claim 8, wherein the first lateral stretch (702) and the second lateral stretch (703) of the incision line (7) are aligned with each other and lie in a first plane parallel to a separating plane in which the separating line (5) lies; and wherein the central stretch (701) lies in the same first plane to form a tab (308) wherein the end edge is aligned with the connecting bands (306; 307).

10. The closing cap (1") according to claim 8, wherein the first lateral stretch (702") and the second lateral stretch (703") of the incision line (7") are aligned with each other and lie in a first plane parallel to a separating plane in which the separating line (5) lies; and wherein the central stretch (701") lies in a second plane parallel to the separating plane and parallel to the first plane to form a tab (308") wherein the end edge projects relative to the connecting bands (306; 307).

11. The closing cap (1'") according to claim 6, and comprising a projection (316), which projects from the joining zone (305) so that, when the closing element (302) is in the open condition and the connecting bands (306, 307) keep the closing element (302) connected to the retaining ring (301), an end edge of a central stretch (701; 701'; 701"; 701"") of the incision line (7; 7'; 7"; 7'") is directed, in the open condition, towards the supply opening of the container and the projection (316) is resting on the neck.

12. The closing cap (1'") according to claim 11, wherein the projection (316) is positioned between the separating line (5) and the incision line (7").

13. The closing cap according to claim 6, wherein the separating line (5) is between the incision line and the free edge (304), the incision line comprising a central stretch positioned between the first lateral stretch and the second lateral stretch, which has a top edge positioned facing an end edge of the closing element (302).

* * * * *